US006387608B2

(12) United States Patent
Morita

(10) Patent No.: US 6,387,608 B2
(45) Date of Patent: May 14, 2002

(54) PHOTOTHERMOGRAPHIC MATERIAL

(75) Inventor: Kiyokazu Morita, Hino (JP)

(73) Assignee: Konica Corporation (JP)

( * ) Notice: Subject to any disclaimer, the term of this patent is extended or adjusted under 35 U.S.C. 154(b) by 0 days.

(21) Appl. No.: 09/823,671

(22) Filed: Mar. 30, 2001

(30) Foreign Application Priority Data

Apr. 6, 2000 (JP) ..... 2000-104695

(51) Int. Cl.[7] ..... G06C 1/498; G06C 1/76

(52) U.S. Cl. ..... 430/536; 430/523; 430/531; 430/619; 430/961

(58) Field of Search ..... 430/961, 523, 430/531, 536, 619

(56) References Cited

U.S. PATENT DOCUMENTS 4,942,115 A * 7/1990 Przeziecki ..... 430/961
5,393,649 A * 2/1995 Baver et al. ..... 430/961
5,422,234 A * 6/1995 Baver et al. ..... 430/961

* cited by examiner

*Primary Examiner*—Richard L. Schilling
(74) *Attorney, Agent, or Firm*—Bierman, Muserlian and Lucas

(57) ABSTRACT

A photothermographic material is disclosed, comprising a support, an image forming layer containing organic silver salt grains, light sensitive silver halide grains and a reducing agent and a surface protective layer on the image forming layer, wherein the element composition on the surface of image forming layer side, obtained by X-ray photoelectron spectroscopy exhibits a ratio of the number of carbon elements to the number of oxygen elements of not more than 9.

11 Claims, 1 Drawing Sheet

PHOTOTHERMOGRAPHIC MATERIAL

FIELD OF THE INVENTION

The present invention relates to photothermographic materials exhibiting superior productivity and handleability during the manufacturing process and also exhibiting superior transportability and stackability when being subjected to thermal processing. The invention also relates to photothermographic materials having enhanced abrasion resistance and exhibiting superior image quality.

BACKGROUND OF THE INVENTION

In the field of graphic arts and medical treatment, there have been concerns processing of photographic fims with respect to effluents produced from wet-processing of image forming materials, and recently, reduction of the processing effluent is strongly demanded in terms of environmental protection and space saving. As a photothermographic material for photographic use and capable of forming distinct black images exhibiting high sharpness, enabling efficient exposure by means of a laser imager or laser image setter known is a thermally developable silver halide photographic material.

Such a photothermographic material comprises a reducible silver source (e.g., organic silver salt), a catalytically active amount of photocatalyst (e.g., silver halide) and a reducing agent, which are dispersed in an organic binder matrix. The photothermographic material is stable at ordinary temperature and after exposure, forms silver upon heating, at a relatively high temperature through an oxidation-reduction reaction between the reducible silver source (which functions as an oxidizing agent) and the reducing agent.

In the photothermographic material used are organic silver salts such as a silver salt of a long chain fatty acid, as a reducible silver source. The organic silver salts can be obtained by mixing an aqueous soluble silver salt with an organic acid such as a long chain fatty acid. For example, after adding an alkali metal salt (e.g., sodium hydroxide, potassium hydroxide) to the organic acid to form an alkali metal soap of the organic acid (e.g., sodium behenate, sodium arachidate), the soap and an aqueous soluble silver salt such as silver nitrate are added by double jet addition to form an organic silver salt.

In such a process, however, it is difficult to alter all of the organic acid to an organic silver salt so that more than a small amount of the organic acid as a raw material remains as an impurity. Further, an organic acid was added to prevent photo-discoloration, as described in JP-A No. 50-59619 (hereinafter, the term, JP-A refers to an unexamined, published Japanese Patent Application).

Photothermographic materials are manufactured employing various coating techniques, including air doctor coating, blade coating, squeezing coating, reverse roll coating, gravure coating, spray coating and bar coating. In cases where two or more layers are coated employing these coating techniques, after the first layer has been dried, the second layer is formed, resulting in insufficient adhesion between layers and thereby leading to lowered production efficiency. An attempt to overcome such problems by simultaneous multi-layer coating, as described in JP-A 11-119375.

However, it was proved that when an image forming layer and a surface protective layer are simultaneously coated, there occurred problems such that an organic acid contained in the image forming layer diffused to the protective layer, forming precipitates on the surface, even when not incorporated into the protective layer. It was further proved that the thus precipitated organic acid deteriorated the physical properties of the surface, producing troubles in transporting or stacking when being subjected to thermal processing stage. Further, it was also proved that when photothermographic materials were processed at a temperature of 100° C. or more using an automatic thermal processor, any contamination with the organic acid softened the surface protective layer, lowering resistance to abrasion.

SUMMARY OF THE INVENTION

Accordingly, it is an object of the present invention to provide a photothermographic material exhibiting superior productivity and handlability in the manufacturing process and also exhibiting superior transportability and stackability in thermal processing.

It is also an object to provide a photothermographic material exhibiting superior image quality without producing abrasion marks.

The object of the invention can be accomplished by the following means:

1. A photothermographic material comprising a support having one side of the support at least an image forming layer containing organic silver salt grains, light sensitive silver halide grains and a reducing agent and a surface protective layer, wherein when the photothermographic material is subjected to X-ray photoelectron spectroscopy with respect to surface element composition, the thereby obtained ratio of the number of carbon elements to the number of oxygen elements of the image forming layer side is not more than 9.

2. A photothermographic material comprising a support having on one side of the support at least an image forming layer containing organic silver salt grains, light sensitive silver halide grains and a reducing agent and a surface protective layer, wherein a layer farthest from the support contains a binder and an organic acid of not more than 5% by weight, based on the binder.

DETAILED DESCRIPTION OF THE INVENTION

Figure 1:
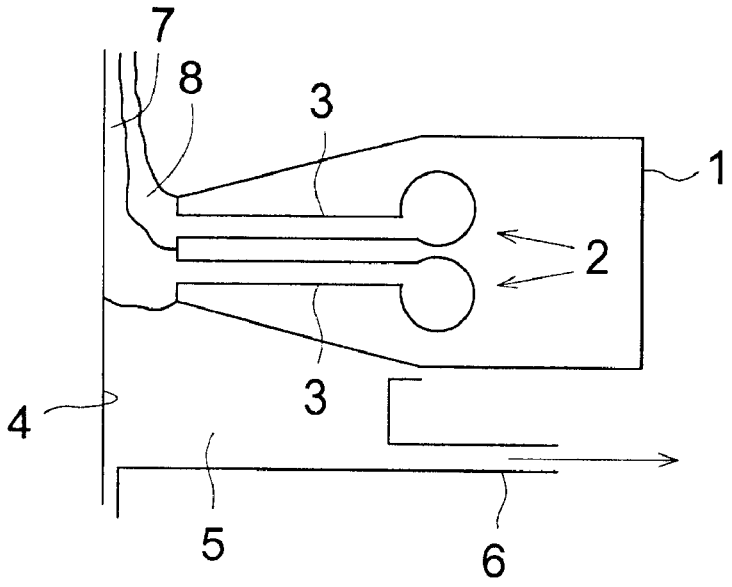
FIG. 1 illustrates an extrusion coater head used in this invention.

The present invention was accomplished based on the discovery that in cases where a photothermographic material containing, as a organic acid, a long fatty acid such as behenic acid or stearic acid is prepared by simultaneous multi-layer coating, it is effective to reduce the organic acid content in the surface layer to a given value or less to achieve the object of the invention.

To enhance productivity in the manufacture of the photothermographic material, an image forming layer and a surface protective layer are preferably simultaneously coated. Simultaneous multi-layer coating is usually conducted preferably by employing a slide hopper system, curtain coating or extrusion coating. In the process of preparing an organic silver salt, an organic acid necessarily remains and to enhance developability or prevent photodiscoloration after development, an organic acid is sometimes incorporated into an image forming layer (hereinafter, this refers to a layer containing organic silver salt grains and light sensitive silver halide grains). In the simultaneously coated image forming layer, other component layer(s) and a protective layer, after being dried, the organic acid easily moves from the lower layer to the surface as the result of interlayer diffusion, relative to the successively coated layers. When the surface layer is contaminated with the organic acid through interlayer diffusion from the image forming layer or other component layer, it often results in precipitation on the surface or deterioration in layer accumulability in cases when photothermographic material sheets are stacked (i.e., the stacked sheets easily slip from the stacks) or produce troubles during transporting. To allow an organic acid to be contained in the essential amount and to prevent its precipitation on the surface, it is necessary to limit the content of the organic acid in the surface layer to no more than a certain amount.

The photothermographic material of the invention comprises a support having on one side of the support an image forming layer containing organic silver salt grains and light sensitive silver halide grains, and a surface protective layer and which was preferably prepared by simultaneously coating the image forming layer and the surface protective layer, so that when the photothermographic material is measured by X-ray photoelectron spectroscopy (or Electron Spectroscopy for Chemical Analysis, ESCA) with respect to element composition on the surface, the photothermographic material exhibits a ratio of the number of carbon element(s) to that of oxygen element(s) of not more than 9. This ratio depends on the content of an organic acid such as a long chain fatty acid silver salt, in the surface layer, from which the organic acid content on the surface can be determined. Long chain fatty acids have a larger ratio of carbon to oxygen than the binder resin so that an increase of the content of the long chain fatty acid results in an increase of the ratio of carbon element number to oxygen element number. An excessively large ratio, which indicates a large amount of an organic acid such as a long fatty acid, is unsuitable. In this invention, transport troubles caused by precipitation of the organic acid, problems such as alteration in photographic performance during stacking, and softening of the layer or adverse effects on transportability, caused by an increased organic acid content in the surface protective layer can be overcome by making the ratio of carbon element number to oxygen element number, to be 9 or less. When the organic acid content exceeds the range of this invention, adhesion of layers, specifically, adhesion between the image forming layer and surface protective layer is deteriorated, easily resulting in stripping.

In this invention, the ratio of the proportion of the number of carbon element, based on the total elements measurable on the surface to that of oxygen element can be determined by X-ray photoelectron spectroscopy (ESCA). Thus, the area of the peak arising from a carbon element or an oxygen element on the surface is determined by the ESCA method. The thus obtained area is multiplied by the detection sensitivity for each element to give a weight and is converted to the number of atoms to determine the proportion thereof. Employing apparatus ESCA RAB200 (available from England VG Co.), measurement was carried out using a light source of Mg-Kα line (1254 EV) at an electron-taking-out angle of 90°. The ESCA is a method for detecting the process and bonding state of constituent atoms employing the photoelectric effect of a substance. When the substance is irradiated with X-rays having a narrow energy width (e.g., Mg-kα line, Al-Kα line), photoelectrons are ejected through the photoelectric effect and from the relationship between the kinetic energy of the ejected electrons and the energy of the irradiated X-rays, the bond energy of the electrons is determined. The thus obtained bond energy is inherent to each atom, thereby enabling identification of the atom.

The ratio of the number of carbon elements to that of oxygen elements can be determined by the ratio of the peak intensity corresponding to a C1s electron of a carbon atom to the peak intensity corresponding to a O1s electron of an oxygen atom. The peak intensity is represented as the intensity value obtained by the ESCA. The Cis electron which has a bond energy of 288 eV, can be detected by measuring at a scanning speed of 0.2 eV/sec or less within the range of 270 to 300 eV; the O1s electron which has a bond energy of 536 eV, can be detected by measuring at a scanning speed of 0.2 eV/sec or less within the range of 500 to 550 eV. The peak intensity can be determined by integrating an intensity curve exhibiting the peak value to determine the area on the base line.

In cases where the ESCA is applied to the surface of a protective layer, the electron-ejected depth is 10 nm from the surface so that the measured electron energy entirely arises only from atoms located in a depth of 10 nm from the surface. Accordingly, the ratio of the number of carbon elements to that of oxygen elements, as defined in this invention is to reflect the ratio of the number of carbon elements located in the vicinity of the surface within a depth of some nm from the surface to the number of oxygen elements. The ESCA spectroscopy is described in "Practical Surface Analysis" vol. 1, D. Briggs and M. P. Seah, John Wirey & Sons Ltd., 1990. The desired value of the ratio of the carbon element number to the oxygen element number can be achieved by controlling the amount of an organic acid contained in the layer farthest from the support, such as a surface protective layer.

In one of the preferred embodiments of this invention, the photothermographic material comprises a support having on one side of the support an image forming layer containing organic silver salt grains and light sensitive silver halide grains, and a surface protective layer, and in cases when the photothermographic material is prepared by simultaneously coating the image forming layer and the surface protective layer, the content of an organic acid contained in the layer farthest from the support, such as a surface protective layer is not more than 5% by weight, based on the total binder contained in the layer. Thereby, an improvement in handling characteristics during the process of thermal processing can be achieved. Thus, not only problems in transport of photothermographic materials, caused by precipitation of an organic acid component, and problems such as falling of stacked photothermographic material sheets are minimized but problems concerning alteration in photographic performance during layer accumulation (stacking) and abrasion resistance concerning softening of the surface layer such as the protective layer, caused by an increased organic acid content can also be overcome.

An organic acid necessarily remains during the process of the preparation of organic silver salt or an organic acid is sometimes incorporated for the purpose of improving characteristics. It is therefore difficult to completely remove the organic acid and a desired amount of the organic acid may be incorporated into an image forming layer or other component layer(s). Thus, it is necessary to control the content of an organic acid in the layer farthest from the support (such as the surface protective layer) and the content is preferably not more than 5%, and more preferably 0.1 to 5% by weight, based on the total binder of the layer. The content exceeding this value results in precipitation of the organic acid, leading to lowering of the softening point of the surface layer. As a result, the photothermographic material is easily abraded and further causes layer slippage or wrinkling. The organic acid content may be at a level of being substantially undetectable by the method described later.

The organic acid is preferably a long chain fatty acid and examples thereof include behenic acid, arachidic acid, stearic acid, palmitic acid and lauric acid.

It is therefore preferred to control the content of the long chain organic acid in the surface layer (or the layer farthest from the support, such as surface protective layer) to be not more than 5% by weight (and preferably 0.1 to 5% by weight), based on the binder of the layer. In cases when the content of the long chain fatty acid is within this value, it is further preferred that the long chain fatty acid has a carbon number of 6 to 22 (and preferably 12 to 22) and a long chain fatty acid having a carbon number of 20 or more accounts for not more than 40% of the fatty acid, thereby enhancing the effects of this invention. An increase of the fatty acid having a carbon number of 20 or more results in deteriorated lubrication property, leading to deteriorated transport characteristics and stacking characteristics.

Accordingly, as described above, of these long chain fatty acids suitable are behenic acid, arachidic acid and stearic acid, whereby transport and stacking characteristics can be suitably maintained.

In this invention, it is preferred to provide an interlayer comprising a polymeric compound between the surface protective layer and image forming layer to prevent diffusion of an organic acid. The polymeric compound contained in the interlayer is preferably a cellulose derivatives or polymeric vinyl compound. When being subjected to simultaneous multi-layer coating, these polymeric compounds form a barrier layer even in the solution state, preventing interlayer diffusion of the organic acid. Examples of the preferred polymeric vinyl-type compound include poly (methyl methacrylate), polyvinyl acetate, polyvinyl butyral and polyvinyl acetoacetal. Examples of the preferred cellulose derivatives, i.e., cellulose ester type compounds include cellulose acetate and cellulose acetate-butyrate. Further, a polymeric compound which is miscible with both of the surface layer and the image forming layer is specifically preferred. Such preferred polymeric compound is poly (methyl methacrylate), polyvinyl acetate butyral and cellulose acetate butyral, and more preferably polyvinyl acetate butyral and cellulose acetate butyral. The amount of a binder in the interlayer is preferably 0.2 to 2 g/m$^2$.

Bonders used in the image forming layer are transparent or translucent and generally colorless, including natural polymers, synthetic polymers or copolymers and film forming mediums. Exemplary examples thereof include gelatin, gum Arabic, polyvinyl alcohol, hydroxyethyl cellulose, cellulose acetate, cellulose acetate butyrate, polyvinyl pyrrolidine, casein, starch, polyacrylic acid, poly(methyl methacrylate), poly(methylmethacrylic acid), polyvinyl chloride, polymethacrylic acid, copoly(styrene-anhydrous maleic acid), copoly(styrene-acrylonitrile), copoly(styrene-butadiene9, polyvinyl acetals (e.g., polyvinyl formal, polyvinyl butyral), polyesters, polyurethanes, phenoxy resin, polyvinylidene chloride, polyepoxides, polycarbonates, polyvinyl acetate, cellulose esters, and polyamides, these of which may be hydrophilic or hydrophobic. Of these binders vinyl acetals such as polyvinyl butyral and polyvinyl acetal, and cellulose esters such as cellulose acetate and cellulose acetate-butyrate are preferred, which may be used alone or in combination. Further, mixed acetals obtained from two aldehydes, such as polyvinyl acetobutyral are also preferred.

It is also preferred to use a polymer exhibiting a glass transition point (Tg) of 60° C. or more (and more preferably 70° C. or more) as at least one of the binder polymers of the image forming layer, thereby prevent diffusion of an organic acid, specifically, a long chain fatty acid and inhibiting diffusion to the surface layer during the manufacture of the photothermographic material. The reason thereof is not clarified but it is assumed that the use of the polymer exhibiting the Tg within this range results in a dried layer state which is rather disadvantageous for diffusion of a long chain fatty acid and specifically a fatty acid having 20 or more carbon atoms.

Preferred binders are vinyl acetals such as polyvinyl butyral and polyvinyl acetoacetal and of these polymers, it is more preferred to select a polymer exhibiting a Tg of not less than 60° C., and more preferably less than 70° C. These polymers may be use alone or in combination. In cases where a polymer exhibiting a Tg less than this value is used, diffusion of an organic acid such as a long chain fatty acid easily occurs. In cases where the Tg is excessively high, layer softening needed in thermal development becomes insufficient, resulting in lowered thermal developability. The Tg is preferably 60 to 150° C., and more preferably 70 to 130° C.

In this invention, the amount of a binder used in the image forming layer is preferably 1.0 to 8 g/m$^2$, and more preferably 1.5 to 5 g/m$^2$. The amount of less than 1.5 g/m$^2$ results in an increase of the density of unexposed areas, often leading to levels unacceptable in practical use.

The binder used in the surface protective layer is preferably one exhibiting a Tg of not less than 120° C. and not more than 300° C., and more preferably not less than 150° C. and not more than 300° C. The use of a binder exhibiting a Tg higher than that of the image forming layer prevents occurrence of abrasion marks and also inhibits diffusion of an organic acid to the surface layer. Examples of such a binder include gelatin, polyamides, polyketones, and cellulose derivatives, which may used alone or in its combination. Of these, cellulose derivative is preferred, such as cellulose acetate-butyrate. The amount of a binder used in the surface protective layer is preferably 1 to 4 g/m$^2$, and more preferably 1.5 to 3.5 g/m$^2$.

In this invention, it is preferred to incorporate an isocyanate compound into a layer farthest from the support, such as surface protective layer, thereby cross-linking the layer and inhibiting diffusion of the organic acid to the surface to prevent precipitation of the organic acid on the surface. The preferred isocyanate compound is represented by the following formula 2

$$O{=}C{=}N{-}L{-}(N{=}C{=}O)v \qquad \text{formula 2}$$

wherein v is 0 or 1; and L is an alkylene, alkenylene, arylenes or alkylarylene group.

It was found that such a isocyanate compound enhanced antifogging stability of photothermographic emulsions. In the formula, the arylenes group may be substituted. Preferred substituent groups include, for example, a halogen atom (e.g., Br, Cl), hydroxy, amino, carboxy and alkoxy groups.

Examples of commercially available isocyanate compounds are shown below, including aliphatic isocyanates, aromatic isocyanates and polymeric isocyanates but are by no means limited to these:

IC-1 Desmodur NIOO, aliphatic isocyanate, available from Movey Corp.

IC-2 Desmodur N3300, aliphatic isocyanate, available from Movey Corp.

IC-3 Mondur TD-80, aromatic isocyanate, available from Movey Corp.

IC-4 Mondur M, aromatic isocyanate, available from Movey Corp.

IC-5 Mondur MRS, aromatic isocyanate, available from Movey Corp.

IC-6 Desmodur W, aliphatic isocyanate, available from Movey Corp.

IC-7 Papi 27 polymeric isocyanate, available from Movey Corp.

IC-8 Isocyanate Y1890 aliphatic isocyanate, available from Huels.

IC-9 Octadecylisocyanate, aliphatic isocyanate, available from Aldrich Corp.

There are also commercially available Colonate 2030, Colonate 2255, Colonate 2513, Colonate 2507, Colonate L. Colonate HL, colonate HK, Colonate HX, Colonate 341, Colonate MX, Colonate 2067 (which are availablew from NIPPON Polyurethane Co.); Talenate D103H, Takenate D204EA, Takenate D-172N, Takenate D-170N (which are available from TAKEDA YAKUHIN Co., Ltd.); Sumijule3200, Sumujule 44V-20 and Sumijule IL (which are available from SUMITOMO Bayern Urethane Co., Ltd.).

The isocyanate compound is preferably used in an amount of not less than 0.002 mol, preferably 0.002 to 2 mol, and more preferably 0.003 to 0.3 mol per mol of silver.

Now, the simultaneous multi-layer coating employed in this invention will be described. In the manufacture of photothermographic materials, the image forming layer and the protective layer are simultaneously coated to enhance productivity. Simultaneous multi-layer coating techniques include a slide hopper system, curtain coating and extrusion coating and of these, extrusion coating is preferred. FIG. 1 illustrates an extrusion coater head. Extrusion coater head (1) is used for simultaneous multi-layer coating according to the wet-on-wet coating method, comprising manifold section (2) and slot section (3), and first and second manifold sections (2) and the slot section being provided along the transport direction of a long run transporting support (4). First slot section (3) is arranged at the forefront side of the transporting direction and second slot section (3) is arranged at the rear side. To the first slot section (3) is supplied an aqueous or oily coating solution used for an image forming layer of the photothermographic material, which is continuously extruded from the manifold section (2); to the second slot section (3) is supplied an aqueous or oily coating solution used for the uppermost protective layer of the photothermographic material, which is also extruded from another manifold section (2); and these coating solutions are simultaneously coated on the support (4) to form image forming layer (7) and further thereon protective layer (8). It is possible to maintain the coating front side at a negative pressure and using an external suction apparatus (which is not shown here), air is sucked from suction inlet (6) to form vacuum section (5), thereby enabling uniform multi-layer coating. Although FIG. 1 shows a die used for the simultaneous two layer coating, the simultaneous three layer coating is similarly arranged.

Light sensitive silver halide emulsions usable in the photothermographic materials according to the invention can be prepared according to the methods commonly known in the photographic art, such as single jet or double jet addition, or ammoniacal, neutral or acidic precipitation. Thus, the silver halide emulsion is prepared in advance and then the emulsion is mixed with other components of the invention to be incorporated into the composition used in the invention. To sufficiently bring the photosensitive silver halide into contact with an organic silver salt, there can be applied such techniques that polymers other than gelatin, such as polyvinyl acetal are employed as a protective colloid in the formation of photosensitive silver halide, as described in U.S. Pat. Nos. 3,706,564, 3,706,565 3,713,833 and 3,748,143, British Patent 1,362,970; gelatin contained in a photosensitive silver halide emulsion is degraded with an enzyme, as described in British Patent 1,354,186; or photosensitive silver halide grains are prepared in the presence of a surfactant to save the use of a protective polymer, as described in U.S. Pat. No. 4,076,539.

The form of silver halide grains is not specifically limited, including cubic or octahedral, regular crystals and non-regular crystal grains in a spherical, bar-like or tabular form. Halide composition thereof is not specifically limited, including any one of silver chloride, silver chlorobromide, silver iodochlorobromide, silver bromide, silver iodobromide, and silver iodide. Silver halide grains are preferably small in size to prevent milky-whitening after image formation and obtain superior images. The grain size is preferably not more than 0.1 $\mu$m, more preferably, 0.01 to 0.1 $\mu$m, and still more preferably, 0.02 to 0.08 $\mu$m. The grain size refers to an edge length when the silver halide grain is a so-called regular crystal, such as octahedral or cubic crystal grain. In the case of non-regular crystal, such as spherical, bar-like or tabular grain, the grain size refers to a diameter of a sphere having a volume identical to that of the grain. Silver halide grains are preferably monodisperse. Further, the expression, monodisperse means that the monodisperse degree defined below is not more than 40%, preferably not more than 30%, and more preferably 0.1 to 20%:

$$\text{monodisperse degree}=(\text{standard deviation of grain size})/(\text{average grain size})\times 100$$

The amount of silver halide is preferably not more than 50%, more preferably 0.1 to 25%, and still more preferably 0.1 to 15%, based on the total amount of silver halide and organic silver salt.

Photosensitive silver halide used in the phtothermographic material of the invention can be formed simultaneously with the formation of organic silver salt by allowing a halide component such as a halide ion to concurrently be present together with organic silver salt-forming components and further introducing a silver ion thereinto during the course of preparing the organic silver salt. Alternatively, a silver halide-forming component is allowed to act onto a pre-formed organic silver salt solution or dispersion or a sheet material containing an organic silver salt to convert a part of the organic silver salt to photosensitive silver halide. These silver halide-forming components are detailed in U.S. Pat. Nos. 4,009,039, 3,457,075 and 4,003,749, British Patent 1,498,956 and JP-A 53-27027 and 53-25420.

The silver halide forming component is used stoichiometrically in a small amount per organic silver salt. Thus, it is preferably 0.001 to 0.7 mol, and more preferably 0.03 to 0.5 mol per mol of organic silver salt.

The thus formed photosensitive silver halide can be chemically sensitized with a sulfur containing compound, gold compound, platinum compound, palladium compound, silver compound, tin compound, chromium compound or their combination. The method and procedure for chemical sensitization are described in U.S. Pat. No. 4,036,650, British Patent 1,518,850, JP-A 51-22430, 51-78319 and 51-81124. As described in U.S. Pat. No. 3,980,482, a low molecular weight amide compound may be concurrently present to enhance sensitivity at the time of converting a part of the organic silver salt to photosensitive silver halide.

To improve reciprocity law failure or adjust contrast, the photosensitive silver halide may be contained with metal ions of the 6th group to 10th group in the periodical table, such as Rh, Ru, Re, Ir, Os, Fe and their complexes and complex ions. Specifically, complex ions are preferred, e.g., Ir complex ions such as $IrCl_6^{2-}$ are preferably contained to improve reciprocity law failure.

Organic silver salts used in the invention are reducible silver source, and silver salts of organic acids or organic heteroacids are preferred, including silver salts of long chain fatty acid (preferably having 10 to 30 carbon atom and more preferably 15 to 25 carbon atoms), such as behenic acid, stearic acid, arachidic acid, palmitic acid and lauric acid, and nitrogen containing heterocyclic compounds such as imidazole, pyrazolo, urazole, 1,2,4-thiazole, 1H-tetrazole, 3-amino-5-benzylthio-1,2,4-triazole and benzotrizole and their complex salts. Specifically, organic or inorganic complexes, ligand of which exhibits a total stability constant to a silver ion of 4.0 to 10.0 are preferred. In addition to these, examples of suitable silver salts are described in RD17029 and RD29963. Of these organic silver salts, silver salts of fatty acids are preferred, and silver salts of behenic acid, arachidic acid and stearic acid are specifically preferred.

The organic silver salt compound can be obtained by mixing an aqueous-soluble silver compound with a compound capable of forming a complex. Normal precipitation, reverse precipitation, double jet precipitation and controlled double jet precipitation described in JP-A 9-127643 are preferably employed. For example, to an organic acid is added an alkali metal hydroxide (e.g., sodium hydroxide, potassium hydroxide, etc.) to form an alkali metal salt soap of the organic acid (e.g., sodium behenate, sodium arachidate, etc.), thereafter, the soap and silver nitrate are mixed by the controlled double jet method to form organic silver salt crystals. In this case, silver halide grains may be concurrently present.

In the present invention, organic silver salts have an average grain diameter of 10 $\mu$m or less and are monodisperse. The average diameter of the organic silver salt as described herein is, when the grain of the organic salt is, for example, a spherical, cylindrical, or tabular grain, a diameter of the sphere having the same volume as each of these grains. The average grain diameter is preferably between 0.05 and 10 $\mu$m, more preferably between 0.05 and 5 $\mu$m and still more preferably between 0.05 and 0.5 $\mu$m. Furthermore, the monodisperse as described herein is the same as silver halide grains and preferred monodispersibility is between 1 and 30%. Organic silver salts are dispersed together with a binder or a surfactant and pulverized to obtain the foregoing particle size or form. The foregoing range leads to a photothermographic material giving a high density image having superior storage stability.

To prevent hazing of the photosensitive material, the total amount of silver halide and organic silver salt is preferably 0.5 to 2.2 g in equivalent converted to silver per $m^2$, leading to high contrast images.

Commonly known reducing agents are used in phtothermographic materials, including phenols, polyphenols having two or more phenols, naphthols, bisnaphthols, polyhydoxybenzenes having two or more hydroxy groups, polyhydoxynaphthalenes having two or more hydroxy groups, ascorbic acids, 3-pyrazolidones, pyrazoline-5-ones, pyrazolines, phenylenediamines, hydroxyamines, hydroquinone monoethers, hydrooxamic acids, hydrazides, amidooximes, and N-hydroxyureas. Suitable reducing agents are selected from the foregoing commonly known reducing agents.

Of these reducing agents, in cases where fatty acid silver salts are used as an organic silver salt, preferred reducing agents are polyphenols in which two or more phenols are linked through an alkylene group or a sulfur atom, specifically, polyphenols in which two or more phenols are linked through an alkylene group or a sulfur atom and the phenol(s) are substituted at least a position adjacent to a hydroxy group by an alkyl group (e.g., methyl, ethyl, propyl, t-butyl, cyclohexyl) or an acyl group (e.g., acetyl, propionyl). Examples thereof include polyphenols compounds such as 1,1-bis(2-hydroxy-3,5-dimethylphenyl)-3,5,5-trimethylhexane, 1,1-bis(2-hydroxy-3-t-butyl-5-methyphenyl)methane, 1,1-bis(2-hydroxy-3,5-di-t-butylphenyl)methane, 2-hydroxy-3-t-butyl-5-methylphenyl)-(2 -hydroxy-5-methylphenyl)methane, 6,6'-benzylidene-bis(2,4-di-t-butylphenol), 6,6'-benzylidene-bis(2-t-butyl-4-methylphenol), 6,6'-benzylidene-bis(2,4-dimethylphenol), 1,1-bis(2-hydroxy-3,5-dimethylphenyl)-2-methylpropane, 1,1,5,5-tetrakis(2-hydroxy-3,5-dimethylphenyl)-2,4-ethylpentane, 2,2-bis(4-hydroxy-3,5-dimethylphenyl)propane, 2,2-bis(4-hydroxy-3,5-di-t-butylphenyl)propane, 2,2'-dihydoxy-1,1'-binaphthyl, 6,6'-dibromo-2,2'-dihydroxy-1,1'-binaphthyl, 6,6'-dinitro-2,2'-dihydroxy-1,1'-binaphtyl, bis(2-hydroxy-1-naphthyl) methane, 4,4'-dimethoxy-1,1'-dihydroxy-2,2'-binaphthyl; sulfonamidophenols or sulfonamidonaphthols, 2-benzenesulfonamidophenol, 2,6-dichloro-4-benzenesulfonamidophenol and 4-benzenesulfonamidonaphthol.

The amount of the reducing agent to be used in the photothermographic material, depending on the kind of an organic silver salt or reducing agent is preferably 0.05 to 10 mol, and more preferably 0.1 to 3 mol per mol of organic silver salt. Two or more kinds of reducing agents may be used in combination within the amount described above. It is also preferred to add the reducing agent to a photosensitive coating solution immediately before coating, in terms of reduced variation in photographic performance occurred during standing.

The photothermographic materials used in this invention preferably contain an image color toning agent to adjust silver image color.

Image toning agents are preferably incorporated into the photothermographic material used in the present invention. Examples of preferred image toning agents are disclosed in Research Disclosure Item 17029, and include the following:

imides (for example, succinimide, naphthalimides, (N-hydroxy-1,8-naphthalimide); cobalt complexes (for example, cobalt hexaminetrifluoroacetate), mercaptans (for example, 3-mercapto-1,2,4-triazole); phthalazinone, phthalazinone derivatives or metal salts thereof (for example, phthalazinone, 4-(1-naphthyl)phthalazinone, 6-chlorophthalazinone, 5,7-dimethylphthalazinone, and 2,3-dihydro-1,4-phthalazinedione); combinations of phthalazine and phthalic acids (for example, phthalic acid, 4-methylphthalic acid, 4-nitrophthalic acid, and tetrachlorophthalic acid anhydride); and combinations of phthalazine and a compound selected from maleic acid anhydride, phthalic acid, , 2,3-naphthalenedicarboxylic acid and o-phenylene acid derivatives and their anhydrides (for example, phthalic acid, 4-methylphthalic acid, 4-nitrophthalic acid, tetrachlorophthalic acid). Of these, phthalazine or combinations of phthalazine and phthalic acids or phthalic acid anhydrides are preferred. The color toning agent is incorporated preferably in an amount of 0.0001 to 2 mol, and more preferably 0.0005 to 1 mol per mol of organic silver salt.

In photothermographic materials used in this invention, spectral sensitizing dyes are employed, as described in JP-A No. 63-159841, 60-140335, 63-231437, 63-259651, 63-304242, 63-15245; U.S. Pat. Nos. 4,639,414, 4,740,455, 4,741,966, 4,751,175, and 4,835,096. Useful sensitizing dye in this invention are also described in RD17643, IV-A (page 23, December, 1978) and ibid 1831X (page 437, August, 1978). Specifically, sensitizing dyes exhibiting sensitivity suitable for spectral characteristics of various scanner light sources can be advantageously selected, as described in JP-A No. 9-34078, 9-54409 and 9-80679.

In this invention, aromatic heterocyclic and condensed aromatic heterocyclic mercapto compounds, disulfide compounds and thione compounds are preferably incorporated to enhance spectral sensitization efficiency and stability before and after being subjected to thermal development. Exemplary examples thereof include 2-mercaptobenzimidazole, 2-mercaptobenzoxazole, 2-mercaptobenzthiazole, 2-mercapto5-methylbenzthiazole, 3-mercapto-1,2,4-triazole, 2 -mercaptoquinoline, 8-mercaptopurine, 2,3,5,6-tetrachloro-4-pyridine-thiol, 4-hydroxy-2-mercaptipyrimidine, and 2-mercapto-4-phenyloxazole. These compounds may be substituted by a substituent group selected from a halogen atom, hydroxy, amino, carboxy, alkyl, and alkoxy groups.

The photothermographic materials used in this invention may contain an antifoggant. Antifoggants are preferably polyhalogen compounds described in U.S. Pat. Nos. 3,874,946 and 4,756,999; and other suitable antifoggants are described in U.S. Pat. No. 5,028,523 and European Patent No. 600,587, 605,981 and 631,176.

In cases where the photothermographic material is specifically employed for the output of a printing image setter with an oscillation wavelength of 600 to 800 nm, hydrazine derivatives described in Japanese Patent Application Nos. 10-344290 and 11-176888 or vinyl compounds described in Japanese Patent Application No. 11-176888 are preferably incorporated into the photosensitive material.

In this invention, the surface layer of the photothermographic material (on the light sensitive layer side or on the opposite side thereto) preferably contains a matting agent to prevent abrasion marks caused by handling before or after subjected to thermal development. The matting agent is contained preferably in an amount of 0.1 to 300 by weight, based on binder.

Materials of the matting agents employed in the present invention may be either organic substances or inorganic substances. Examples of the inorganic substances include silica described in Swiss Patent No. 330,158, etc.; glass powder described in French Patent No. 1,296,995, etc.; and carbonates of alkali earth metals or cadmium, zinc, etc. described in U.K. Patent No. 1.173,181, etc. Examples of the organic substances include starch described in U.S. Pat. No. 2,322,037, etc.; starch derivatives described in Belgian Patent No. 625,451, U.K. Patent No. 981,198, etc.; polyvinyl alcohols described in Japanese Patent Publication No. 44-3643, etc.; polystyrenes or polymethacrylates described in Swiss Patent No. 330,158, etc.; polyacrylonitriles described in U.S. Pat. No. 3,079,257, etc.; and polycarbonates described in U.S. Pat. No. 3,022,169. The matting agent employed in the present invention preferably has an average particle diameter of 0.5 to 10 $\mu$m, and more preferably of 1.0 to 8.0 $\mu$m. Furthermore, the variation coefficient of the size distribution is preferably not more than 50 percent, is more preferably not more than 40 percent, and is most preferably not more than 30 percent.

The photothermographic material used in this invention may contain nonionic, anionic, cationic or betaine type fluorinated surfactant to improve lubrication property or enhance antistatic property.

The photothermographic material used in this invention may contain heteroatom-containing macrocyclic compounds, representative one of which is known as a crown ether compound, as described in Oda, Shono, Tbuse, "Chemistry of Crown Ether Compound" (KAGAKUDOJIN, 1078); Tabuse "Host-Guest" (KYORITSU-SHUPPAN, 1979); Sasaki, Koga, J. Soc. Organic Synthesis Chemistry, vol. 145 (6) 571–582 (1987).

In addition to the foregoing compounds, various additives may be incorporated into an image forming layer, light insensitive layer, or other component layers. The photothermographic material used in this invention may be contained with additives such as a surfactant, antioxidant, stabilizer, plasticizer, UV absorbent or coating-aid. These additive and other additives are described in Research disclosure 17029 (June, 1978, page 9–15).

Supports usable in the phtothermographic materials include various kinds of polymeric materials, glass, wool fabric, cotton fabric, paper, metal (e.g., aluminum) and those which are convertible to flexible sheets or rolls are preferred in terms of handling as information recording material. Preferred supports usable in phtothermographic materials are plastic resin films (e.g., cellulose acetate film, polyester film, polyethylene terephthalate film, polyethylene naphthalate film, polyamide film, polyimide film, cellulose triacetate film, polycarbonate film) and biaxially stretched polyethylene terephthalate film is specifically preferred. The thickness of the support is preferably 50 to 300 $\mu$m, and more preferably 70 to 180 $\mu$m.

Supports used in this invention are usually subjected to a surface treatment to enhance adhesion to a coated layer such as an image forming layer or a back layer of the photothermographic material. In cases where hydrophobic polymer films are employed as a support, such surface treatments include a surface activation treatment such as a corona discharge treatment, UV-ray treatment, glow discharge treatment, plasma discharge treatment, and flame treatment, and an etching treatment such as resorcin treatment, phenols treatment, alkali treatment, amine treatment and trichloroacetic acid treatment. Of such surface treatments preferred are the corona discharge treatment, plasma treatment and flame treatment, and the corona treatment and plasma treatment are specifically preferred.

After being subjected to the surface treatment described above, the support is provided with a sublayer. Materials used as a sublayer are not specifically limited but examples thereof include copolymers obtained by using, as a starting material, vinyl chloride, vinylidene chloride, butadiene, methacrylic acid, acrylic acid, itaconic acid and or anhydrous maleic acid; polyethyleneimine, polyeste, polystyrene, polyurethane, epoxy resin, grafted gelatin, nitrocellulose and a mixture thereof. The additives described above or later may be incorporated into the sublayer. It is also preferable to provide eletric conductivity to the sublayer. The specific surface resistance (at 23° C. and 20% RH) of the conductive side is preferably not more than $1\times10^{12}$ Ω, more preferably not more than $5\times10^{11}$ Ω, and still more preferably not more than $1\times10^{11}$ Ω.

In one of preferred embodiments of this invention, the photothermographic material is prepared by dissolve or disperse materials of each the foregoing constituent layers in solvents to form a coating solution, simultaneously coating a plurality of such coating solutions and drying them. The expression, simultaneously coating means that coating solutions for constituent layers are each prepared, and each of the thus prepared coating solutions is not separately coated but two or more of them are simultaneously coated and dried to form constituent layers. The method for simultaneously coating plural constituent layers is not specifically limited but known methods such as bar code coating, curtain coating, immersion coating, air-knife coating, hopper coating and extrusion coating are applicable. Of these coating methods, extrusion coating is preferred. The extrusion coating causes no evaporation on the slide face and is therefore suitable for accurate coating or organic solvent coating.

The photothermographic material of this invention comprises an image forming layer, an interlayer and a protective layer on the support and on the other side of the support, a backing layer is preferably provided to prevent adhesion between photothermographic materials. To control the amount or the wavelength distribution of transmitting light, a filter layer may be provided on the light sensitive layer side or on the opposite side or a dye or pigment may be allowed to be contained in the light sensitive layer. There may be provided two or more image forming layers, such as high-speed and low-speed layers to control contrast. The foregoing additives may be incorporated into these layers. Electrically conductive compounds such as metal oxides and/or conductive polymers may be incorporated into the constituent layer to improve electrification property. Such compounds may be incorporated into any layer but preferably into a sublayer, a backing layer or an image forming layer. Conductive compounds described in U.S. Pat. No. 5,244,773 (col. 14 through 20) are preferred.

The photothermographic material, which is stable at ordinary temperatures, is exposed and heated at a high temperature (preferably 80 to 200° C., and more preferably 100 to 150° C.) to undergo development. In cases when heated at a temperature of lower than 80° C., sufficient image density can be obtained within a short time. Further, in cases when heated at a temperature of higher than 200° C., a binder melts and is transferred to a roller, adversely affecting not only images but also transportability and a processsing machine.

Thermal development conditions are variable with a used instrument, apparatus or means, and thermal development may be conducted employing typical heating means such as a hot plate, iron, hot roller and a heat generator using carbon or white titanium. It is preferred to conduct thermal development by heating a transporting photothermographic material, while being brought into contact with a heated roller, in terms of thermal efficiency and working property.

Any light source within the infrared region is applicable to exposure of the phtothermographic material, and infrared semiconductor lasers (780 nm, 820 nm) are preferred in terms of high power and transmission capability through the photosensitive material.

In the invention, exposure is preferably conducted by laser scanning exposure. It is also preferred to use a laser exposure apparatus, in which a scanning laser light is not exposed at an angle substantially vertical to the exposed surface of the photosensitive material. The expression "laser light is not exposed at an angle substantially vertical to the exposed surface" means that laser light is exposed preferably at an angle of 55 to 88°, more preferably 60 to 86°, still more preferably 65 to 84°, and optimally 70 to 82°. When the photosensitive material is scanned with laser light, the beam spot diameter on the surface of the photosensitive material is preferably not more than 200 μm, and more preferably not more than 100 μm. Thus, a smaller spot diameter preferably reduces the angle displacing from verticality of the laser incident angle. The lower limit of the beam spot diameter is 10 μm. The thus laser scanning exposure can reduce deterioration in image quality due to reflected light, resulting in occurrence such as interference fringe-like unevenness.

Exposure applicable in the invention is conducted preferably using a laser scanning exposure apparatus producing longitudinally multiple scanning laser beams, whereby deterioration in image quality such as occurrence of interference fringe-like unevenness is reduced, as compared to a scanning laser beam of the longitudinally single mode. Longitudinal multiplication can be achieved by a technique of employing backing light with composing waves or a technique of high frequency overlapping. The expression "longitudinally multiple" means that the exposure wavelength is not a single wavelength. The exposure wavelength distribution is usually not less than 5 nm and not more than 10 nm. The upper limit of the exposure wavelength distribution is not specifically limited but is usually about 60 nm.

It is preferred that when subjected to thermal development, the photothermographic material contains an organic solvent. Examples of solvents include ketones such as acetone, isophorone, ethyl amyl ketone, methyl ethyl ketone, methyl isobutyl ketone; alcohols such as methyl alcohol, ethyl alcohol, n-propyl alcohol, isopropyl alcohol, n-butyl alcohol, isobutyl alcohol, diacetone alcohol, cyclohexanol, and benzyl alcohol; glycols such as ethylene glycol, dimethylene glycol, triethylene glycol, propylene glycol and hexylene glycol; ether alcohols such as ethylene glycol monomethyl ether, and dimethylene glycol monomethyl ether; ethers such as ethyl ether, dioxane, and isopropyl ether; esters such as ethyl acetate, butyl acetate, amyl acetate, and isopropyl acetate; hydrocarbons such as n-pentane, n-hexane, n-heptane, cyclohexene, benzene, toluene, xylene; chlorinated compounds such as chloromethyl, chloromethylene, chloroform, and dichlorobenzene; amines such as monomethylamine, dimethylamine, triethanol amine, ethylenediamine, and triethylamine; and water, formaldehyde, dimethylformaldehyde, nitromethane, pyridine, toluidine, tetrahydrofuran and acetic acid. The solvents are not to be construed as limiting these examples. These so;vents may be used alone or in combination. The solvent content in the photosensitive material can be adjusted by varying conditions such as temperature conditions at the drying stage after the coating stage. The solvent content can be determined by means of gas chromatography under the conditions suitable for detecting the solvent.

EXAMPLES

The present invention will be described based on examples but the invention is by no means limited to these.

Example 1

Preparation of Photographic Support

Polyethylene terephthalate (hereinafter, also simply denoted as PET) photographic support was prepared in the following manner.

One side of a blue-tinted polyethylene terephthalate film base exhibiting a blue density of 0.170 (175 μm thick) was subjected to corona discharging at 0.5 kV·A·min/m$^2$·min. Further thereon, the sub-coating composition A descried below was applied so as to form a dried layer thickness of 0.2 μm, which was then dried. The resulting coating was designated Subbing Layer A. Onto the opposite surface which was also subjected to corona discharging at 0.5 kV·A·min/m$^2$, the sub-coating composition B described below was applied to form a dried layer thickness of 0.1 μm.

The resulting coating was designated Subbing Layer B. Thereafter, the support was subjected to a thermal treatment in a thermal oven provided with a film transport apparatus having plural roll groups at 130° C. for 15 min.

Sub-coating composition A

Copolymer latex solution (30% solids) of 270 g, comprised of 30% by weight of n-butyl acrylate, 20% by weight of t-butyl acrylate, 25% by weight of styrene and 25% by weight of 2-hydroxyethyl acrylate was mixed with 0.6 g of compound (UL-1). Further thereto a dispersion in which 1.3 g of SYLYSIA-350 (available from FUJI SYLYSIA Co.) was previously dispersed in 100 g of water by a ultrasonic dispersing machine, Ultrasonic Generator (available from ALEX Corp.) at a frequency of 25 kHz and 600 W for 30 min., was added and finally water was added to make 100 ml to form sub-coating solution A.

Synthesis of colloidal tin oxide dispersion

Stannic chloride hydrate of 65 g was dissolved in 2000 ml of water/ethanol solution. The prepared solution was boiled to obtain coprecipitates. The purified precipitate was taken out by decantation and washed a few times with distilled water. To the water used for washing, aqueous silver nitrate was added to confirm the presence of chloride ions. After confirming no chloride ion, distilled water was further added to the washed precipitate and concentrated to 470 ml to obtain a colloidal tin oxide dispersion.

Sub-coating solution B

The foregoing colloidal tin oxide dispersion of 37.5 g was mixed with 3.7 g of copolymer latex solution (30% solids) comprised of 10% by weight of n-butyl acrylate, 35% by weight of t-butyl acrylate, 27% by weight of styrene and 28% by weight of 2-hydroxyethyl acrylate, 14.8 g of copolymer latex solution (30% solids) comprised of 40% by weight of n0butyl acrylate, 20% by weight of styrene and 40% by weight of glycidyl methacrylate, and 0.1 g of compound 8UL-1) and water was further added to make 1000 ml to obtain sub-coating solution B.

UL-1

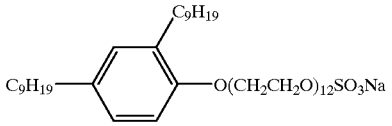

Back Layer-side Coating

A back layer coating solution having a composition shown below was prepared. The coating solution was coated on the sublayer B of the support and dries so as to form a dry layer of 3 $\mu$m. Drying was conducted at a drying temperature of 100° C. and a dew point of 10° C. over a period of 5 min.

Back Layer Coating Solution 1

To 784 g of methyl ethyl ketone, 4.5 g of polyester resin (Vitel PE2200B, available from Bostic Corp.) was added with stirring for 10 min. Then CAB381-20 (cellulose acetate-butyrate, available from Eastman Chemical Co.) was added separately four times and stirred until being dissolved. To the resulting solution were added 0.50 g of infrared dye 1, 4.5 g fluorinated surfactant (Surflon KH40, available from ASAHI Glass Co. Ltd.) and 1.7 g fluorinated anionic surfactant (EF-105, available from TOCHEM PRODUCT Co.) and stirring further continued for 0.5 hr. To the resulting solution, 27 g of methyl ethyl ketone and 1.1 g of SYLYSIA-440 (colloidal silica, available from FUJI SYLYSIA Co.) were added and stirred by a dissolver type stirrer at 8000 rpm for 30 min. Further, immediately before coating, 30 g of 10% methyl ethyl ketone solution of hardener Desmodur N3300 (aliphatic isocyanate, available from Movey Co.) was added to make a back layer coating solution.

Preparation of Light Sensitive Silver Halide Emulsion A

In 900 ml of deionized water were dissolved 7.5 g of gelatin having an average molecular weight of 100,000 and 10 mg of potassium bromide. After adjusting the temperature and the pH to 35° C. and 3.0, respectively, 370 ml of an aqueous solution containing 74 g silver nitrate and an equimolar aqueous solution containing potassium bromide, potassium iodide (in a molar ratio of 98 to 2) and $1\times10^{-4}$ mol/mol Ag of iridium chloride were added over a period of 10 minutes by the controlled double-jet method, while the pAg was maintained at 7.7. Thereafter, 4-hydroxy-6-methyl-1,3, 3a,7-tetraazaindene was added and the pH was adjusted to 5 using NaOH. There was obtained cubic silver iodobromide grains having an average grain size of 0.06 $\mu$m, a variation coefficient of the projection area equivalent diameter of 10 percent, and the proportion of the {100} face of 87 percent. The resulting emulsion was flocculated to remove soluble salts, employing a flocculating agent and after desalting, 0.1 g of phenoxyethanol was added and the pH and pAg were adjusted to 5.9 and 7.5, respectively to obtain silver halide emulsion A. The thus obtained photosensitive emulsion grains were measured with respect to the average iodide content in the vicinity of the grain surface and it was proved to be 4.0 mol %.

Preparation of Powdery Organic Silver Salt A

In 4720 ml water were dissolved 324 g of behenic acid, 99 g of arachidic acid and 56 g of stearic acid at 80° C. Then, after adding 980 ml of 1.5M aqueous sodium hydroxide solution with stirring and further adding 9.3 ml of concentrated nitric acid, the solution was cooled to a temperature of 55° C. to obtain an aqueous organic acid sodium salt solution. To the solution were added the silver halide emulsion A obtained above (containing equivalent to 0.09 mol silver and 1400 g water) and stirring further continued for 5 min., while maintained at a temperature of 55° C. Subsequently, 1470 ml of 1M aqueous silver nitrate solution was added in 2 min. and stirring continued further for 20 min., then, the reaction mixture was filtered to remove aqueous soluble salts. Thereafter, washing with deionized water and filtration were repeated until the filtrate reached a conductivity of 2 $\mu$S/cm, and after subjecting to centrifugal dehydration, the reaction product was dried with heated air at 37° C. until no reduction in weight was detected to obtain powdery organic silver salt A.

Preparation of Light Sensitive Emulsion dispersing Solution A

In 14.57 g methyl ethyl ketone was dissolved 14.57 g of polyvinyl butyral powder (Butvar B-79, available from Monsanto Corp.) and further thereto was gradually added 500 g of the powdery organic silver salt A with stirring by a dissolver type homogenizer. Thereafter, the mixture was dispersed using a media type dispersion machine (available from Gettzmann Corp.), which was packed 1 mm Zr beads (available from Toray Co. Ltd.) by 80%, at a circumferential speed of 13 m and for 3 min. of a retention time with a mill to obtain photosensitive emulsion dispersing solution A.

Preparation of Infrared Sensitizing Dye Solution

Infrared sensitizing dye 1 of 350 mg, 13.96 g of 2-chlorobebzoic acid and 2.14 g of 5-methyl-2 -mercaptobenzimidazole were dissolved in 73.4 g of methanol in a dark room to obtain an infrared sensitizing dye solution.

Preparation of Stabilizer Solution

Stabilizer 1 of 1.0 g and 0.5 g of potassium acetate were dissolved in 8.5 g of methanol to obtain a stabilizer solution.

Preparation of Developer Solution

Developing agent 1,1-bis(2-hydroxy-3,5-dimethylphenyl)-2-methylpropane of 17.74 g was dissolved in methyl ethyl ketone (also denoted as MEK) to make 100 ml of a developer solution.

Preparation of Antifoggant solution

Antifoggant 2 of 5.81 g was dissolved in methyl ethyl ketone to make 100 ml of a stabilizer solution.

Preparation of Image forming Layer Coating Solution

| | |
|---|---|
| Antifoggant solution (above-described) | 5.47 ml |
| Developer solution (above-described) | 14.06 ml |
| IC-2 (10% MEK solution) | 1.60 ml |

Infrared sensitizing dye 1

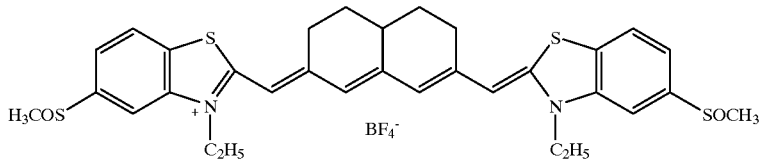

Stabilizer

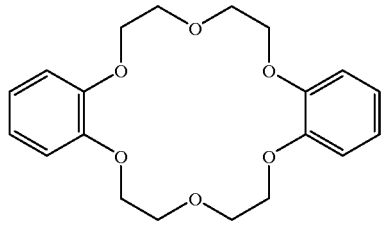

Antifoggant 1

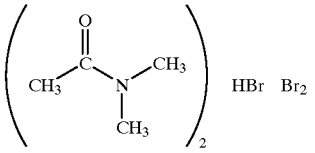

Antifoggant 2

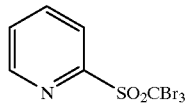

Infrared dye 1

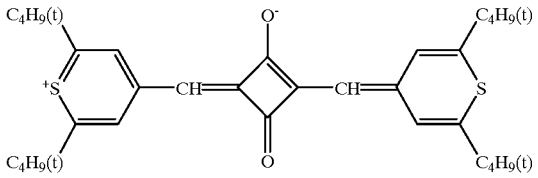

Light sensitive emulsion dispersing solution A of 50 g and 15.11 g of MEK were mixed and maintained at 21° C., and 390 μl of 10% antifoggant 1 methanol solution was added thereto and stirred for 1 hr. Further thereto, 889 μm of 10% calcium bromide methanol solution of calcium bromide was added and stirred for 30 min. Subsequently, 1.416 ml of infrared sensitizing dye solution and 667 μl of stabilizer solution were added thereto and stirred for 1 hr. and then cooled to a temperature of 13° C. and further stirred for 30 min. Further, 13.3 g of polyvinyl butyral (Butvar B-79, available from Monsanto Co., Tg=64° C.) was added thereto and sufficiently dissolved with stirring for 30 min., while maintaining the temperature at 13° C.; then, the following additives were added at intervals of 15 min.

| | |
|---|---|
| Phthalazine | 305 mg |
| Tetrachlorophthalic acid | 102 mg |
| 4-Methylphthalic acid | 137 mg |
| Infrared dye 1 | 37 mg |

Then, after stirring for 15 min., the following additives were successively added with stirring to obtain an image forming layer coating solution:

Fine particle dispersing solution

To 85 g of methyl ethyl ketone, 1 g of CAB171-15 (cellulose acetate-butyrate, available from Eastman Chemical Co.) was added with stirring and stirring further continued by a dissolver type stirrer until being completely dissolved. Further thereto, 10 g of SYLOID 320 (Silica, available from FUJI SYLYSIA Co.) was added and stirred at 8000 rpm for 45 min.

Surface Protective Layer Coating Solution

To 870 g of methyl ethyl ketone, 3.5 g of polymethyl methacrylate (Paraloid A-21, available from Rohm & Haas Corp.) was added stirred for 10 min. Then, 102 g of cellulose acetate-butyrate (CAB171-15, available from Eastman Chemical Co.) was divided into four portions, each of them was separately added and stirred for 1 hr. Further thereto, 0.1 g of benzotriazole, 8.9 g of phthalazine, 1.5 g of 1,3-bis (vinylsilfonyl)-2-hydroxypropane, 2.0 g of fluorinated non-ionic surfactant (Surflon KH40, available from ASAHI Glass Co. Ltd.) and 0.2 g of a fluorinated anionic surfactant (EF-105, available from TOCHEM PRODUCT Co.) were added and dissolved for 30 min. The foregoing dispersing solution of 1.1 g was added thereto with stirring and the isocyanate compound shown in Table 1 was further added thereto to obtain a surface protective coating solution.

Interlayer Coating Solution

To 425 g of methyl ethyl ketone, 75 g of polymethyl methacrylate (Paraloid A-21, available from Rohm & Haas Corp.) was added stirred for 1 hr. to obtain an interlayer coating solution.

Image Forming Layer-side Coating

After coating a back coat layer on the subbed support, the image forming layer coating solution and surface protective layer coating solution were successively coated on the sublayer A of the support using an extrusion coater. Coating was conducted at a coating speed of 20 m/min so as to form an image forming layer having a silver coverage of 2.0 g/m$^2$ and drying was conducted for 5 min with hot air of a dry bulb temperature of 70° C. and a dew point of 10° C. Similarly, the protective layer was coated and dried so as to have a binder content of 2.5 g/m$^2$. Photothermographic material Sample 101 was thus obtained.

Photothermographic material Sample 102 was prepared similarly to Sample 101, provided that the binder used in the image forming layer was replaced by polyvinyl acetoacetal (Eslex KS-1, Tg=1–7° C., available from SEKISUI Chemical Co., Ltd.), as shown in Table 1. Sample 103 was also prepared similarly to Sample 101, provided that the image forming layer and the protective layer were simultaneously coated employing a die as shown in FIG. 1. Samples 104 through 111 were similarly prepared by simultaneous coating, provided that in Samples 105, 106, 109 and 111, an interlayer containing the the above-described Paraloid A-21 (available from Rohm & Haas Corp.) and CAB171-15 (cellulose acetate-butyrate, available from Eastman Chemical Co.) was provide between the image forming layer and protective layer by simultaneous coating employing a die for use in three-layer coating and an isocyanate compound was added to the surface protective layer, as shown in Table 1.

Exposure and Thermal Processing

Samples each were cut to a size of 34.5cm×43 cm and allowed to stand under the condition at 23° C. and 55% RH, for 12 hrs. Thereafter, each of the thus aged samples was subjected to laser scanning exposure from the emulsion side using an exposure apparatus having a light source of 800 to 820 nm semiconductor laser of longitudinal multi-mode, which was made by means of high frequency overlapping. In this case, exposure was conducted at an angle of 70°, between the exposed surface and exposing laser light (and as a result, images with superior sharpness were unexpectedly obtained, as compared to exposure at an angle of 90°). Subsequently, using an automatic processor provided with a heated drum, exposed samples were subjected to thermal development at 110° C. for 15 sec., while bringing the protective layer surface of the photothermographic material into contact with the drum surface. Thermal development was conducted in an atmosphere at 23° C. and 50% RH.

Evaluation

Organic acid content of protective layer

Photothermographic material samples were each cut to a size of 20 cm$^2$ and a cellophane tape was adhered to the protective layer side and then pulled to peel the protective layer. The thus peeled protective layer was immersed in 30 ml of methnol, together with the cellophane tape, for 30 min. After concentrating the solution, 15 ml of methanol and 5 ml of hydrochloric acid were added and the mixture was refluxed with boiling for 30 min. After concentrating the solution again, the concentrate was dried in vacuo. Thereto, 1 ml of 0.04% by volume solution of ethyl palmitate and methanol was added to make 10 ml. The resulting solution was subjected to gas chromatography according to the following conditions:

Apparatus: HP Column: HP1, 30 cm×0.32 mm×0.25 $\mu$m (produced by Hewlett Packard Co.)

Inlet temperature: 250° C.

detection temperature: 280° C.

Carrier gas: He

From the thus obtained gas chromatogram, the organic acid content was determined using ethyl palmitate, as an internal standard.

Adhesion test

Adhesion between the image forming layer and protective layer was tested according to the evaluation method of JIS K 5600-5-6, in which ranks of 1 to 5 Based on JIS evaluation were replaced by A through E. Thus, using an equivalent interval spacer (i.e., a spacer having equivalent intervals9, each was notched to a grid-like form having a width of 3 mm and a tape was adhered thereto. Then, the tape was peeled at an angle of 60° and the resulting sample was evaluated withrespect to the remaining unpeeled area, based on the following criteria:

A: cut edge was completely smooth and no flaking was observed in any grid,

B: slight flaking was observed at some intersecting-cut positions but the affected intersecting-cut portions were not more than 5%, C: flaking occurred along cut edges and/or at intersecting cuts and the affected intersecting-cut portions accounted for 5 to 15%, D: flaking occurred partially or entirely along cut edges and/or intersections and the affected portions accounted for 15 to 35%, E: marked flaking occurred along the entire cut edges and at the intersections, and the affected portions accounted for more than 35%, and F: more marked flaking occurred than grade "E".

Ratio of Carbon Element Number to Oxygen Element Number

Measurement was carried out using Mg-K$\alpha$ line (1254 eV), as the X-ray excitation source and ESCA RAB200 type (VG Co., England).

Transport test 100 identical size sheets of each sample were continuously subjected to thermal processing and the number of transport troubles occurred were counted.

Stacking Characteristic

Unitable stacking characteristics were evaluated in the following manner. Thus, 100 Sheets of each of the photothermographic material samples were superposed, gradually inclined and evaluated with respect to the angle at the time the stacked sheets became unstable and began to fall down, based on the following criteria:

E: 0 to less than 5°,

D: 5 to less than 10°,

C: 10 to less than 15°,

D: 15 to less than 20°,

E: not less than 20°.

TABLE 1

| Sample No. | Light Sensitive Layer Binder | Light Sensitive Layer Tg (° C.) | Interlayer binder | Protective Layer Isocyanate | Protective Layer Binder | Protective Layer Coating | ESCA C/O Ratio | Organic Acid Content (%) |
|---|---|---|---|---|---|---|---|---|
| 101 | PVB*1 | 64 | — | — | CAB171-15 2.5 g/m$^2$ | Seq.*2 | 10.6 | 5.6 |
| 102 | PVAC*1 | 107 | — | — | CAB171-15 2.5 g/m$^2$ | Seq. | 10.2 | 5.5 |
| 103 | PVB | 64 | — | — | CAB171-15 2.5 g/m$^2$ | Sim.*3 | 11.5 | 6.1 |
| 104 | PVB | 64 | — | Takenate D170N 2.5 g/m$^2$ | CAB171-15 2.5 g/m$^2$ | Sim. | 4.5 | 3.6 |
| 105 | PVB | 64 | Paraloid A-21 0.5 g/m$^2$ | — | CAB171-15 2.5 g/m$^2$ | Sim. | 3.5 | 3.8 |
| 106 | PVB | 64 | CAB500-5 0.5 g/m$^2$ | — | CAB171-15 2.5 g/m$^2$ | Sim. | 3.3 | 3.7 |
| 107 | PVAC | 107 | — | — | CAB171-15 2.5 g/m$^2$ | Sim. | 7.2 | 4.0 |
| 108 | PVAC 30<br>PVB 70 | 107<br>64 | — | — | CAB171-15 2.5 g/m$^2$ | Sim. | 7.5 | 4.3 |
| 109 | PVAC 30<br>PVB 70 | 107<br>64 | Paraloid A-21 0.5 g/m$^2$ | — | CAB171-15 2.5 g/m$^2$ | Sim. | 3.2 | 3.5 |
| 110 | CAB500-5 30<br>PVB 70 | 96<br>64 | — | Takenate D170N 0.2 g/m$^2$ | CAB171-15 2.5 g/m$^2$ | Sim. | 3.6 | 3.4 |
| 111 | PVAC 30<br>PVB 70 | 107<br>64 | Paraloid A-21 0.5 g/m$^2$ | Takenate D170N 0.2 g/m$^2$ | CAB171-15 2.5 g/m$^2$ | Sim. | 3.4 | 3.3 |

*1PVB: Polyvinyl butyral B-79 (Butvar B-79), Tg = 64° C., Mw = 250,000 (Monsant Corp.)
PVAC: polyvinyl acetoacetal KS-1 (Eslex KS-1) Tg = 107° C., Mw = 150,000 (SEKISUI Chemical Co.)
CAB500-5: Cellulose acetate-butyrate, Tg = 96° C., Mw = 57,000, (Eastman Chemical Corp.)
*2Seq.: Sequential coating
*3Sim.: Simultaneous coating

TABLE 2

| Sample No. | Stackability | Adhesion | Transport | Remark |
|---|---|---|---|---|
| 101 | E | E | 5 | Comp. |
| 102 | E | E | 4 | Comp. |
| 103 | E | C | 0 | Comp. |
| 104 | A | B | 0 | Inv. |
| 105 | B | A | 0 | Inv. |
| 106 | A | A | 0 | Inv. |
| 107 | A | B | 0 | Inv. |
| 108 | B | B | 0 | Inv. |
| 109 | A | A | 0 | Inv. |
| 110 | A | B | 0 | Inv. |
| 111 | A | A | 0 | Inv. |

As apparent from Tables 1 and 2, it was proved that the ration of 3 to 9 of carbon element number to oxygen element number of the surface led to superior results in transport characteristic as well as stable stacking characteristic.

Example 2

Photothermographic material Samples 201 through 207 were prepared similarly to Example 1, provided that the binder of the image forming layer, interlayer and protective layer; and hardener and coating system were varied, as shown in Tables 3 and 4. Samples were evaluated with respect to stacking characteristics, adhesion and percentage of organic acids having 20 or more carbon atoms. Further, samples were tested with respect to abrasion resistance according to the following manner.

Thus, photothermographic material samples, immediately or 2 hrs. after being subjected to thermal processing, were measured with respect to hardness, according to the pencil hardness measuring method described in JIS K 5400. Each sample was placed on a sample table and scratched for a length of 1 cm by a pencil with pressing the top of pencil onto the surface of the sample at an angle of 45°. The scratching was repeated five times using pencils having identical density term (such as HB, F, B, 2B, H, 2H, etc.) at the time when two or more times produced abrasion marks was designated as the pencil hardness.

TABLE 3

| Sample No. | Light sensitive Layer Binder | Interlayer binder | Protective layer Hardener | Protective layer Binder | Protective layer Coating | Org. Acid Content (%) | Org. Acid*1 (%) |
|---|---|---|---|---|---|---|---|
| 201 | PVB*2 | — | — | CAB171-15 2.5 g/m$^2$ | Seq.*3 | 6.1 | 45.6 |
| 202 | PVB | — | — | CAB171-15 2.5 g/m$^2$ | Sim.*4 | 6.7 | 46.6 |

TABLE 3-continued

| Sample No. | Light sensitive Layer Binder | Interlayer binder | Protective layer Hardener | Protective layer Binder | Coating | Org. Acid Content (%) | Org. Acid*1 (%) |
|---|---|---|---|---|---|---|---|
| 203 | PVB | — | Takenate D170N 2.5 g/m$^2$ | CAB171-15 2.5 g/m$^2$ | Sim. | 3.6 | 35.1 |
| 204 | PVB | CAB500-5 0.5 g/m$^2$ | — | CAB171-15 2.5 g/m$^2$ | Sim.* | 3.5 | 35.3 |
| 205 | PVAC*2 | — | — | CAB171-15 2.5 g/m$^2$ | Sim.* | 4.5 | 37.3 |
| 206 | PVAC 30 PVB 70 | — | — | CAB171-15 2.5 g/m$^2$ | Sim.* | 4.3 | 37.6 |
| 207 | PVAC 30 PVB 70 | Paraloid A-21 0.5 g/m$^2$ | Takenate D170N 0.2 g/m$^2$ | CAB171-15 2.5 g/m$^2$ | Sim.* | 3.3 | 34.6 |

*1Percentage of organic acid having 20 or more carbons
*2PVB: Polyvinyl butyral B-79 (Butvar B-79), Tg = 64° C., Mw = 250,000 (Monsant Corp.)
PVAC: polyvinyl acetoacetal KS-1 (Eslex KS-1) Tg = 107° C., Mw = 150,000 (SEKISUI Chemical Co.)
CAB500-5: Cellulose acetate-butyrate, Tg = 96° C., Mw = 57,000, (Eastman Chemical Corp.)
*3Seq.: Sequential coating
*4Sim.: Simultaneous coating

TABLE 4

| Sample No. | ESCA C/O Ratio*1 | Abrasion Resistance (1)*2 | Abrasion Resistance (2)*3 | Stack-ability | Adhe-sion | Remark |
|---|---|---|---|---|---|---|
| 201 | 10.7 | 3B | B | E | E | Comp. |
| 202 | 11.5 | 4B | B | E | C | Comp. |
| 203 | 4.7 | 2B | HB | A | B | Inv. |
| 204 | 3.7 | HB | HB | A | A | Inv. |
| 205 | 7.1 | B | HB | B | B | Inv. |
| 206 | 7.3 | B | HB | A | B | Inv. |
| 207 | 3.4 | HB | HB | A | A | Inv. |

*1Ratio of carbon to oxygen by number, obtained by ESCA.
*2Immediately after development
*32 hr. after development As can be seen from Tables 3 and 4, inventive photothermographic material samples led to superior results.

What is claimed is:

1. A photothermographic material comprising a support, an image forming layer containing organic silver salt grains, light-sensitive silver halide grains and a reducing agent and a surface protective layer on the image forming layer, wherein the element composition on the surface of image forming layer side exhibits a ratio of the number of carbon elements to the number of oxygen elements of not more then 9, the element composition being obtained by X-ray photoelectron spectroscopy; and an outermost surface layer of the image forming layer side contains an isocyanate compound.

2. A photothermographic material comprising a support, an image forming layer containing organic silver salt grains, light-sensitive sliver halide grains and a reducing agent and a surface protective layer on the image forming layer, wherein the element composition on the surface of image forming layer side exhibits a ratio of the number of carbon elements to the number of oxygen elements of not more than 9, the element composition being obtained by X-ray photoelectron spectroscopy; and an outermost surface layer of the image forming layer side contains a binder and two or more organic acids in an amount of not more than 5% by weight, based on the binder, the proportion of an organic acid having at least 20 carbon atoms being 0.1 to 35% by weight, based on total organic acids.

3. A photothermographic material comprising a support, an image forming layer containing organic silver salt grains, light-sensitive silver halide grains and a reducing agent and a surface protective layer on the image forming layer, wherein the element composition on the surface of image forming layer side exhibits a ratio of the number of carbon elements to the number of oxygen elements of not more than 9, the element composition being obtained by X-ray photoelectron spectroscopy; an outermost surface layer of the image forming layer side contains a binder and one or more organic acids in an amount of not less then 0.1% and not more than 5% by weight, based on the binder.

4. A photothermographic material comprising a support, an image forming layer containing organic silver salt grains, light-sensitive silver halide grains and a reducing agent and a surface protective layer on the image forming layer, wherein the element composition on the surface of image forming layer side exhibits a ratio of the number of carbon elements to the number of oxygen elements of not more than 9, the element composition being obtained by X-ray photoelectron spectroscopy, and wherein an interlayer is provided between the image forming layer and the surface protective layer and contains a binder comprised of poly (methyl methacrylate), poly(vinylacetate butyral) or cellulose acetate butyral; the image forming layer, the interlayer and the surface protective layer have been provided by a process of simultaneously coating the image forming layer, the interlayer and the surface protective layer on the support.

5. The photothermographic material of claim 4, wherein the binder is comprised of poly(vinylacetate butyral) and cellulose acetate butyral.

6. A photothermographic material comprising a support, an image forming layer containing organic silver salt grains, light-sensitive silver halide grains and a reducing agent and a surface protective layer on the image forming layer, wherein the element composition on the surface of image forming layer side exhibits a ratio of the number of carbon elements to the number of oxygen elements of not more than 9, the element composition being obtained by X-ray photoelectron spectroscopy, and wherein an interlayer is provided between the image forming layer and the surface protective layer and contains a binder of 0.2 to 2 g/m$^2$, and the surface protective layer containing a binder of 1 to 4 g/m$^2$, the image forming layer, the interlayer and the surface protective layer have been provided by a process of simultaneously coating the image forming layer, the interlayer and the surface protective layer on the support.

7. A photothermographic material comprising a support, an image forming layer containing organic silver salt grains, light-sensitive silver halide grains and a reducing agent and a surface protective layer on the image forming layer, wherein the element composition on the surface of image forming layer side exhibits a ratio of the number of carbon elements to the number of oxygen elements of not more than 9, the element composition being obtained by X-ray photoelectron spectroscopy, and wherein the image forming layer contains a binder exhibiting a glass transition point of 60 to 150° C. which comprises a water insoluble polymer including vinyl acetals or cellulose esters, and the surface protective layer containing a binder exhibiting a glass transition point higher than the binder of the image forming layer.

8. A photothermographic material comprising a support, an image forming layer containing organic silver salt grains, light-sensitive sliver halide grains and a reducing agent and a surface protective layer on the image forming layer, wherein the element composition on the surface of image forming layer side exhibits a ratio of the number of carbon elements to the number of oxygen elements of not more than 9, the element composition being obtained by X-ray photoelectron spectroscopy, and wherein the photothermographic material further comprises an interlayer between the image forming layer and the surface protective layer, the image forming layer containing a binder which comprises a polymer exhibiting a glass transition point of not less than 70° C. and the surface protective layer containing a binder exhibiting a glass transition point higher than the image forming layer; and the image forming layer, the interlayer and the surface protective layer have been provided by a process of simultaneously coating the image forming layer, the interlayer and the surface protective layer on the support.

9. The photothermographic material of claim 8, wherein an outermost surface layer contains an isocyanate compound of 0.002 to 2 mol per mol of silver, the image forming layer containing 1.0 to 8 g/m$^2$ of the binder comprised of polyvinyl butyral, polyvinyl acetoacetal or a mixture thereof.

10. The photothermographic material of claim 9, wherein the interlayer contains a binder comprised of a cellulose derivative or a polymeric vinyl compound, in an amount of 0.2 to 2 g/m$^2$.

11. A photothermographic material comprising a support having on one side of the support at least an image forming layer containing organic silver salt grains, light sensitive silver halide grains and a reducing agent and a surface protective layer, wherein a layer farthest from the support contains a binder and two or more organic acids, the proportion of an organic acid having at least 20 carbon atoms being 0.1 to 35% by weight, based on total organic acids and the total organic acid content being not less than 0.1% by weight and not more than 5% by weight, based on the binder.

* * * * *